United States Patent [19]

Boggia

[11] Patent Number: 4,756,098

[45] Date of Patent: Jul. 12, 1988

[54] ATHLETIC SHOE

[75] Inventor: Joseph F. Boggia, Ponte Vedra, Fla.

[73] Assignee: GenCorp Inc., Akron, Ohio

[21] Appl. No.: 5,650

[22] Filed: Jan. 21, 1987

[51] Int. Cl.[4] ..... A43B 1/00; A43B 23/25

[52] U.S. Cl. ..... 36/114; 36/57

[58] Field of Search ..... 36/45, 50, 57, 58.5, 36/84, 85, 88, 91, 114, DIG. 2, 129

[56] References Cited

U.S. PATENT DOCUMENTS

| | | | |
|---|---|---|---|
| Re. 26,340 | 2/1968 | Dassler . | |
| D. 188,037 | 5/1960 | Dassler . | |
| D. 257,074 | 9/1980 | Gucci . | |
| 1,258,629 | 3/1918 | Bliss . | |
| 2,383,122 | 8/1945 | Ghez et al. . | |
| 2,660,813 | 12/1953 | Shapiro | 36/129 |
| 3,138,880 | 6/1964 | Kunzli | 36/114 |
| 3,224,117 | 12/1965 | Dassler . | |
| 3,583,081 | 6/1971 | Hayashi . | |
| 3,768,182 | 10/1973 | Powers . | |
| 4,067,124 | 1/1978 | Rys-Sikora . | |
| 4,245,408 | 1/1981 | Larsen . | |
| 4,255,876 | 3/1981 | Johnson . | |
| 4,280,287 | 7/1981 | Gulbransen . | |
| 4,314,413 | 2/1982 | Dassler et al. . | |
| 4,342,161 | 8/1982 | Schmohl . | |
| 4,366,631 | 1/1983 | Larsen . | |
| 4,393,605 | 7/1983 | Spreng . | |
| 4,571,856 | 2/1986 | Lin et al. . | |
| 4,592,154 | 6/1986 | Oatman . | |
| 4,598,487 | 7/1986 | Misevich . | |

OTHER PUBLICATIONS

An advertisement appearing on p. 47 of the Sep. 4, 1986 issue of "Tennis Week".

Modern Textiles, article, Kevlar Aramid by Robert Wilfong, Feb. 1976.

*Primary Examiner*—Donald Watkins

[57] ABSTRACT

An athletic shoe generally has a plurality of strips of an inextensible material, such as graphite, which extend from the lace area rearwardly over the shoe exterior and into a non-ground contacting area of a laminated sole. The weight of the wearer also bears upon the strip sole ends and aids in retarding movement thereof. The shoe has good forward as well as lateral stability.

22 Claims, 1 Drawing Sheet

ATHLETIC SHOE

FIELD OF THE INVENTION

The present invention relates to improving the lateral and forward stability of an athletic shoe such as a tennis shoe. More specifically, generally a plurality of inextensible strips are utilized which extend from the lace area of a shoe rearwardly and into the interior area of a laminated sole where it is firmly attached.

BACKGROUND

Heretofore, athletic shoes have been utilized for various activities including sports, for example basketball, baseball, football, and generally in athletic games wherever forward or lateral stresses are placed upon the shoe. Since most athletic shoes are made of light weight materials such as thin leather or synthetic fabrics, they give and stretch and thus provide poor stability for the foot. Various reinforcing materials have been applied to athletic shoes in an effort to improve stability. However, good lateral and forward stability is generally lacking.

Design Pat. No. 188,037, to Dassler, merely relates to a specific aesthetic embodiment of a shoe which has three lateral strips thereon.

Design Pat. No. 257,074, to Gucci, relates to another aesthetic design having lateral strips of the shoe upper.

U.S. Pat. No. Re. 26,340, to Dassler, relates to a running shoe made of very thin and thus stretchable leather. Only a half sole portion 3 exists with the remainder of the bottom portion being soft leather. Plastic strips 2 exist to maintain the bottom rear portion of the shoe in close contact with the bottom of a foot.

U.S. Pat. No. 1,258,629, to Bliss, relates to a shoe having reinforcing strips of leather or canvas which act to preserve the original shape of the upper during use.

U.S. Pat. No. 2,383,122, to Ghez et al, relates to a shoe sole having a reinforcement element therein.

U.S. Pat. No. 3,138,880, to Kunzli, relates to an athletic shoe having side straps 28 thereon as well as rear strap 42.

U.S. Pat. No. 3,224,117, to Dassler, is a patent which was reissued as U.S. Pat. No. Re 26,340 discussed hereinabove.

U.S. Pat. No. 3,583,081, to Hayashi, relates to an athletic shoe containing reinforcement strips 8 which are secured to the sides of the upper for strengthening and ornamenting the same.

U.S. Pat. No. 3,768,182, to Powers, relates to an athletic shoe which has soft sidewalls for comfort and reinforcing overlays for providing stiffness as well as to distribute lacing forces.

U.S. Pat. No. 4,067,124, to Rys-Sikora, relates to a shoe having reduce color migration of the dyed fabric upper. The shoe contains reinforcing strips 20 thereon.

U.S. Pat. Nos. 4,245,408 and 4,366,631, to Larsen, et al, relate to an athletic shoe having a low-cut heel portion and a side strap attached from the heel portion to the lacing portion to effectively lock the heel portion with the front portion when used.

U.S. Pat. No. 4,255,876, to Johnson, relates to an athletic shoe having a reinforcing strip 20 thereon.

U.S. Pat. No. 4,280,287, to Gulbransen, relates to an athletic shoe having a pocket on the side thereof for containing an article. A plurality of reinforcing strips appear to exist on the side portions of the upper.

U.S. Pat. No. 4,314,413, to Dassler, relates to a sport shoe having an extended sole at the heel end.

U.S. Pat. No. 4,342,161, to Schmohl, relates to a low sport shoe having a bandage connecting the lacing strip with the sole which bandage is less extensible than the material of the upper.

U.S. Pat. No. 4,393,605, to Spreng, relates to a thick soled sport shoe having a toe cap thereon partitioned into several parallel strips.

U.S. Pat. No. 4,571,856, to Lin, et al, relates to a double laced athletic shoe having reinforcing strips thereon.

U.S. Pat. No. 4,592,154, to Oatman, relates to an athletic shoe having a plurality of pliant retaining bands to effect securement of the shoe and especially a shoe cushion therein to the foot of a user.

U.S. Pat. No. 4,598,487, to Misevich, relates to an athletic shoe having a precompression of a constrained midsole portion to enhance the midsole's energy absorbing capacity.

An advertisement by Reebok Shoes relates to a lateral polyurethane support strap which extends from the lower portion of the lacing strip to the sole area of the shoe.

The above patents and document generally relate to reinforcing strips of a stretchable material such as leather, and lack any securement of the reinforcing strips within the sole portion of the shoe such that improved forward stability as well as lateral stability are obtained.

SUMMARY OF THE INVENTION

Figure 1:
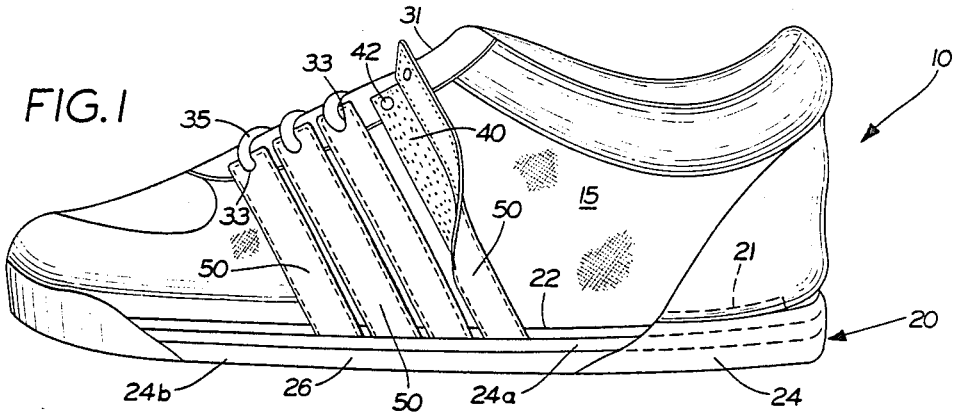
FIG. 1 is a side elevational view of an athletic shoe of the present invention showing the graphite strips.

It is therefore an aspect of the present invention to provide an athletic shoe typically having a plurality of inextensible strips on the upper which improves lateral and forward stability.

It is another aspect of the present invention to provide an athletic shoe having lateral and forward stability, as above, wherein said strips extend from a lace area to substantially into a laminated sole.

It is still another aspect of the present invention to provide an athletic shoe, having lateral and forward stability, as above, wherein said inextensible strips are made of encapsulated graphite fibers and wherein said graphite fibers extend about the eyelets of the shoe upper.

These and other aspects of the present invention will become apparent from the following detailed description.

In general, an athletic shoe comprises a laminated sole and an upper, said laminated sole comprising a midsole and an outersole, a lace area, said lace area residing on said upper, one or more inextensible strips, said strips having a lace end and a sole end, said strips residing on said upper, said lace end of said strips attached to said lace area and said sole end of said strips extending a sufficient distance into said sole laminate so that lateral and forward stability is imparted to the shoe.

DETAILED DESCRIPTION

An athletic shoe such as a tennis shoe, generally indicated by the numeral 10, has an upper portion 15 and a laminated sole portion generally indicated by the Numeral 20. Upper portion 15 can be made of conventional materials such as leather or more desirably synthetic materials such as polyester fabric, nylon fabric, polyvinyl chloride fiber, as well as other various conventional synthetic and natural fabrics. The athletic shoe generally has an interior liner made of a soft material, not shown, which is known to the art and to the literature. Moreover, the upper heel portion of the upper may be built up with additional fabric, liners, foam cores, etc. to provide a comfortable surface, all as known to the art and to the literature.

The sole portion 20 of the shoe is generally a laminate in that it contains a plurality of layers of typically tough, shock-absorbing but flexible materials such as various rubbers, urethanes, dual density compounds, and the like. The specific materials of the sole is not a part of the present invention and such materials are known to the art as well as to the literature. Although any number of layers can be utilized to form the sole, typically at least two layers exist and extend the length of the shoe, that is from the toe portion through the heel portion. The innersole 21, which is not a part of the laminate, resides on the laminate and is usually placed thereon although it can be adhered thereto. The innersole generally acts as a cushion and hence is made of a pliant resin or rubber material. The midsole layer 22 is a top layer of the laminated sole and is attached or connected to the shoe upper through an adhesive, or can be melt adhered or stitched thereto. The midsole layer is generally semirigid or hard and, hence, can be made out of a fiberous or a semirigid material. The bottom or outer sole layer 24 contacts the ground and is generally made of an abrasive resistant, tough, durable material such as a compounded rubber. The outer sole 24 often contains multiple layers such as intermediate layer 24A, made out of a urethane or a rubber, and tread layer 24B generally made out of a rubber compound which can have any number of tread designs therein to improve traction as with regard to an all purpose shoe or to a specific purpose show, for example a basketball shoe. The outer layer(s) 24 is also attached to the midsole in any conventional manner as by an adhesive, melt adherence and the like. Laminate sole 20 thus effectively retains its shape throughout use of the shoe.

Upper 15 has a slit 31 or opening which generally extends along the central axis portion of the upper from the ankle down towards the toe portion. Slit 31 creates an opening which is internally stradled by tongue 32. Eyelets 33 extend along the length of periphery of the slit and have laces 35 extending therethrough. Eyelets 33 can be made in any conventional manner and generally is merely an aperture in the upper material or an aperture bounded by a plastic or metal annulus. Since a plurality of eyelets 33 exist, a lace area is created along the edges of slit 31. Alternately, speed laces, not shown, can exist in lieu of eyelet 33, as known to the art and to the literature.

Figure 3:
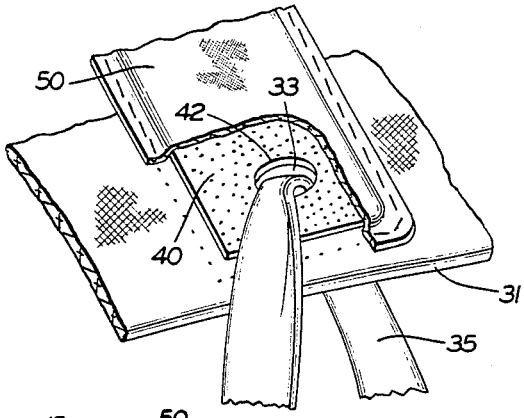
FIG. 3 is a perspective view showing the graphite strip eyelet.

According to the concepts of the present invention, one or more inextensible strips 40 generally extend from the lace area rearwardly and downwardly along the side of the upper and into laminated sole 20. In order to permit flexing of the lace area or midportion of the shoe, a plurality of strips 40 are preferred. It is important that strips 40 be made of an inextensible and yet flexible material. That is, the material is not capable of being elongated or stretched but is flexible in that it can be bent, that is, in a direction lateral of the central axis of the shoe. Examples of suitable inextensible materials include fiberglass, such as encapsulated fiberglass, polyester, and polyaramide, with graphite as in the form of encapsulated fibers being preferred. An example of an encapsulating material is a flexible epoxy. An end of the strips resides within the lace area such as the eyelets and hence is referred to as the lace end. Preferably, strips 40 extend about eyelets 33 as shown in FIG. 3. Thus, an aperture 42 exists in strip 40 and generally has the same diameter as eyelet 33. In the case of fiberous containing strips, the fibers are located about the eyelet so that during usage thereof, the eyelet remains intact. The inextensible strips thus effectively secure the sole of the shoe to the foot.

Figure 2:
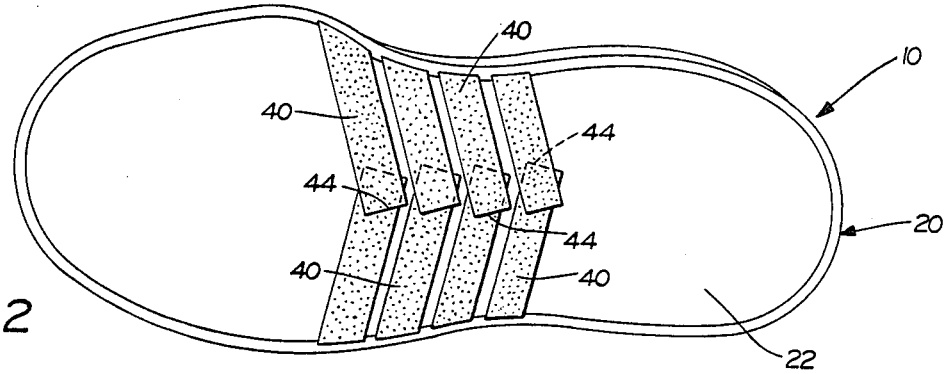
FIG. 2 is a bottom view showing the midsole and the graphite strips residing substantially thereon.

The extensible strips 40 reside on the exterior surface of the upper and are desirably attached thereto in any conventional manner as through the use of an adhesive, stiching, or the like. The remaining end portion extends into the laminated sole a sufficient distance so that lateral and forward stability is imparted to the shoe. The strip sole end can extend into any of the interior portions between the various sole laters but not upon the exterior surface of the outer layer 26 where it will contact the ground and be readily worn. Generally, the extension of the strip sole end is from about 45% to about 100% and desirably from about 70% to about 100% of the distance from the outer edge of the midsole to the central axis thereof. Preferably, the strips are fully extended so that they overlap the ends of the strips on the remaining side of the shoe as shown in FIG. 2. Alternatively, a single strip can exist which extends from eyelet to eyelet. Desirably, the strip sole ends extend into the sole at the bottom of the midsole. That is, the strip will extend into the sole interior between the midsole and the outer sole and is applied thereto in any conventional manner such as through the use of an adhesive. In any event, the strip ends are attached to the sole interior so that it is effectively laminated or encapsulated therein.

The purpose of inextensible strips 40 is to provide a secure and taut abutment of upper 15 to a foot as well as to provide a close engagement of sole 20 with the bottom of the foot. That is, it is highly desirable to eliminate as much, if not all, movement as possible between upper 15 and sole 20 with the foot. The athletic shoe would thus operate in its most efficient manner. Another advantage of the present invention is that inasmuch as the strip extends into the sole, when weight or pressure is applied to the sole, such weight will keep the strip from moving laterally or transversely outward whereby play or movement can be imparted to the strips. The existence of a rearward angle is highly desirable in that forces from the lace area as well as side portion of the foot are transferred back towards the middle of the shoe.

It is an important aspect of the present invention that the angle of the strips, with regard to the vertical, be within a specific range such that the shoe has good forward as well as lateral stability. Considering a vertical line to be an angle of 90 degrees (from the horizontal), the rearward angle of the strips is generally from about 55 degrees to about 75 degrees, desirably from about 60 degrees to about 72 degrees with an angle of from about 65 degrees to about 70 degrees being preferred. A large angle generally in excess of 75 degrees from the horizontal does not result in pull down of the foot and, hence, loses forward stability. That is, a rearward angle in excess of 75 degrees tends to permit the foot to slide forward and thus permits it to come in contact with the shoe toe box which can cause injury. A rearward angle less than 55 degrees is undesirable since lateral stability of the shoe is reduced and "rollover" can result which can also cause injury.

Figure 4:
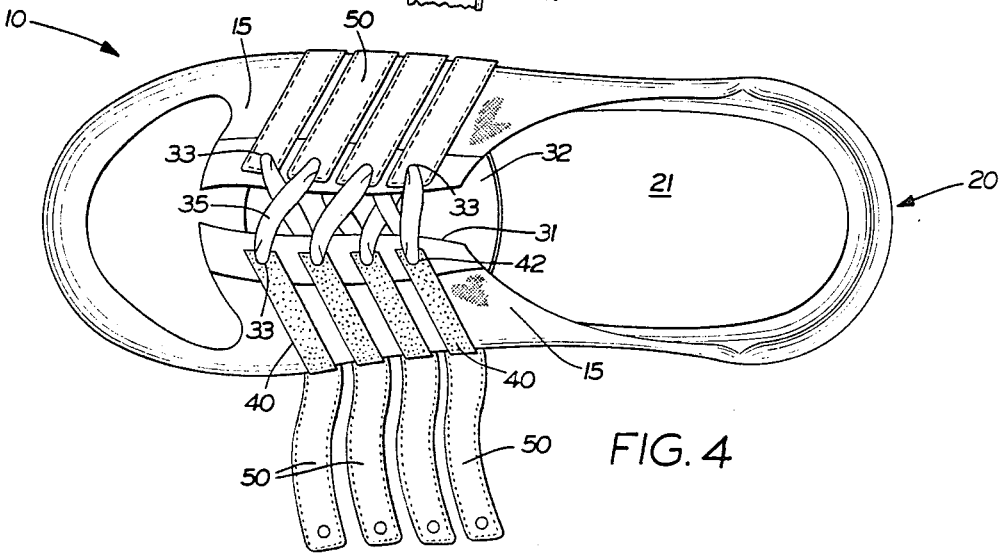
FIG. 4 is a top elevational view showing the lace area.

Since strips 40 are nonexpandable, any forward motion applied to the lace area of the shoe will be inelastically restrained and transferred about the side of the foot to the midsection of the sole. Inasmuch as strip ends 44 extend substantially into the sole section, very little forward movement of the foot is permitted, thereby imparting forward stability to the shoe. For example, when a person is wearing the shoes of the present invention and a forward force applied to the shoe as when stopping, inextensible strips 40 will retain the foot in place and not permit the upper to stretch. "Freeplay" or "slop" is thus essentially eliminated. When a lateral force is applied to the shoe, movement of the foot in such a direction is generally effectively restrained by inextensible straps 40. That is, if a force is applied by a foot in the direction of the top portion of FIG. 4, the foot would tend to override or "rollover" the sole portion of a conventional shoe. However, inasmuch as inextensible straps 40 effectively bond the entire forward foot portion, a reactive force is immediately transferred to the bottom straps of FIG. 4, that is to the left side of the shoe, which is transmitted to the laminated sole. The laminated sole prevents any extention or movement of the left side straps which, through the laces, prevents movement of the straps located on the right side of the shoe. Thus, the straps impart lateral stability to the shoe and prevent substantial movement of the foot to either lateral side thereof.

According to the present invention, great stresses can be applied to the shoe upper without loosening or breaking the engagement of the strips to the sole. In contrast, such forces cannot generally be applied if strap sole ends were merely stiched to the sole and not inserted substantially into the sole interior portion.

In order to enhance the aesthetic appearance of a shoe of the present invention, cover strips 50 can be attached to inextensible strips 40 as by stiching, through the use of an adhesive, etc. Cover strips 50 can be made out of any suitable material such as synthetic fabrics, leather, etc.

While in accordance with the Patent Statutes, a best mode and preferred embodiment have been set forth in detail, the scope of the invention is not limited thereto, but rather by the scope of the attached claims.

What is claim is:

1. An athletic shoe, comprising:

a laminated sole and an upper, said laminated sole comprising at least a midsole and an outersole, a lace area, said lace area residing on said upper, one or more flexible inextensible strips, said strip having a lace end and a sole end, said strip residing on said upper, said lace end of said strip attached to said lace area and said sole end of said strip extending into said laminated sole at least 45 percent of the distance from the outer edge of said laminated sole to the center axis of said sole laminate and attached thereto so that lateral and forward stability is imparted to the shoe.

2. An athletic shoe according to claim 1, wherein said inextensible strip lace ends are attached to said upper.

3. An athletic shoe according to claim 1, wherein said lace area has eyelets therein and wherein said inextensible strip engages said eyelet.

4. An athletic shoe according to claim 3, including a plurality of said inextensible strips, said inextensible strips extend rearwardly and downwardly from said lace area to said sole..

5. An athletic shoe according to claim 4, wherein said inextensible strips extend rearwardly at a angle of from about 55 degrees to about 75 degrees.

6. An athletic shoe according to claim 5, wherein said inextensible material is fiberglass, graphite, or polyester, or polyaramide.

7. An athletic shoe according to claim 6, wherein said inextensible strips are attached to the midsole of said shoe.

8. An athletic shoe according to claim 7, wherein said strips are encapsulated to the underside of said midsole, and wherein said encapsulated strips extend entirely across said sole.

9. An athletic shoe according to claim 8, wherein said inextensible strips are made from encapsulated graphite fibers.

10. An athletic shoe according to claim 2, wherein the length of said sole extends along the entire length of said shoe.

11. An athletic shoe according to claim 7, wherein the length of said sole extends along the entire length of said shoe.

12. An athletic shoe according to claim 1, wherein said inextensible strips extend rearwardly and downwardly from said lace area to said sole, and wherein said rearward angle is from about 55 degrees to about 75 degrees.

13. An athletic shoe according to claim 12, wherein said inextensible strips extend entirely across said sole interior.

14. An athletic shoe according to claim 13, wherein said lace area has eyelets or speed laces and wherein said inextensible strips engage said eyelets or said speed laces.

15. An athletic shoe according to claim 14, wherein said inextensible strips are attached to the midsole of said sole, wherein said rearward angle is from about 60 degrees to about 72 degrees, and wherein said inextensible strips extend at least 70% into said sole interior.

16. An athletic shoe according to claim 15, wherein said inextensible strips are laminated to the underside of said midsole.

17. An athletic shoe according to claim 16, wherein said inextensible material is encapsulated graphite.

18. An athletic shoe according to claim 13, wherein said inextensible strips are capable of providing a taut abutment of said upper to a foot and providing a close engagement of said sole with the bottom of said foot, and wherein upon the application of pressure by said foot to said sole, said inextensible strips substantially eliminate movement between said shoe and said foot.

19. An athletic shoe according to claim 16, wherein said inextensible strips are capable of providing a taut abutment of said upper to a foot and providing a close engagement of said sole with the bottom of said foot, and wherein upon the application of pressure by said foot to said sole, said inextensible strips substantially eliminate movement between said show and said foot.

20. An athletic shoe, comprising:

a laminated sole and an upper, said laminated sole having a plurality of layers, one or more flexible inextensible strips, said inextensible strip being incapable of elongation, a laced area, said lace area residing on said upper, said inextensible strip residing on said upper and extending from said lace area into said laminated sole area an amount of at least 45 percent of the distance from the sole outer edge to the central axis of said sole.

21. An athletic shoe according to claim 20, including a plurality of said inextensible strips, wherein said inextensible strips contain graphite fibers.

22. An athletic shoe according to claim 21, wherein said inextensible strips extend rearwardly and downwardly from said lace area to said sole, and wherein said rearward angle is from about 60 degrees to about 72 degrees.

* * * * *